United States Patent [19]

Neri

[11] Patent Number: 5,074,745

[45] Date of Patent: Dec. 24, 1991

[54] APPARATUS FOR FEEDING PACKAGING MACHINES WITH STACKS OF SHEET MATERIAL

[75] Inventor: Armando Neri, Bologna, Italy

[73] Assignee: G.D. S.p.A., Bologna, Italy

[21] Appl. No.: 558,366

[22] Filed: Jul. 27, 1990

[30] Foreign Application Priority Data

Aug. 1, 1989 [IT] Italy ..... 3576 A/89

[51] Int. Cl.[5] ..... B65G 59/02

[52] U.S. Cl. ..... 414/796.9; 294/104; 294/907; 414/795.8; 414/929

[58] Field of Search ..... 414/792.9, 795.8, 796.9, 414/929, 416; 294/104, 907

[56] References Cited

U.S. PATENT DOCUMENTS 4,911,608 3/1990 Krappitz et al. ..... 414/796.9

FOREIGN PATENT DOCUMENTS 2847164 5/1979 Fed. Rep. of Germany ... 414/796.9

3613462 10/1987 Fed. Rep. of Germany ... 414/796.9

3907332 7/1990 Fed. Rep. of Germany ..... 901/7

52-59475 5/1977 Japan ..... 414/792.9

2203723 10/1988 United Kingdom ..... 414/796.9

*Primary Examiner*—David A. Bucci

*Assistant Examiner*—Janice Krizek

*Attorney, Agent, or Firm*—Guido Modiano; Albert Josif

[57] ABSTRACT

The apparatus for feeding packaging machines with stacks of sheet material comprises a unit for removing and transferring stacks of sheet material which are arranged mutually side by side on supports, so as to form superimposed layers separated by supporting trays which have, in an upward position, ridges which define, below each stack, a through opening. The removal and transfer unit has a head provided with a grip element which can laterally approach each stack through the opening, grip the stack in a clamp-like manner and transfer it to a station for feeding the material in sheets to the packaging machine. A device for removing the emptied supporting trays is provided.

4 Claims, 2 Drawing Sheets

APPARATUS FOR FEEDING PACKAGING MACHINES WITH STACKS OF SHEET MATERIAL

BACKGROUND OF THE INVENTION

The present invention relates to an apparatus for feeding packaging machines with stacks of sheet material, in particular cardboard cutouts for rigid cigarette packets.

As known, cigarette packaging machines are fed with stacks of cardboard cutouts intended to constitute the outer container of the packets.

The stacks of cardboard cutouts are arranged on a belt conveyor which advances with a stepwise motion so as to convey said stacks to means which transfer the individual cardboard cutouts to a processing line of the machine.

The stacks of cutouts are currently arranged manually on the input conveyor of the packaging machine.

The conveyor in turn feeds a tank or hopper which feeds a stripper element suitable for separating the individual cutouts to be transferred to the machine processing line.

This feeding system is rather complicated and limits the productivity of the machine, besides entailing a considerable labor cost.

SUMMARY OF THE INVENTION

The aim of the present invention is to solve the above described problem by means of an apparatus which feeds packaging machines with stacks of cardboard cutouts in a completely automatic manner.

A further object of the present invention is to provide an apparatus which is simple in concept, safely reliable in operation and versatile in use.

According to the present invention, an apparatus is provided for feeding packaging machines with stacks of material in sheets, characterized in that it comprises a unit for removing and transferring stacks of sheet material, said stacks being arranged mutually side by side on supporting means, so as to form superimposed layers, separated by supporting trays which have, on their upper face, raised portions suitable for defining at least one space below each stack, said removal and transfer unit having a head which is vertically and horizontally movable, a stack gripping element supported by said head and being insertable into said space to grip said stack and subsequently movable to a feeding station of said packaging machine, and means for removing the emptied supporting trays.

BRIEF DESCRIPTION OF THE DRAWINGS

The invention is now described with reference to the accompanying illustrative, non-limitative drawings, of a preferred embodiment thereof, wherein.

DESCRIPTION OF THE PREFERRED EMBODIMENTS

Figure 1:
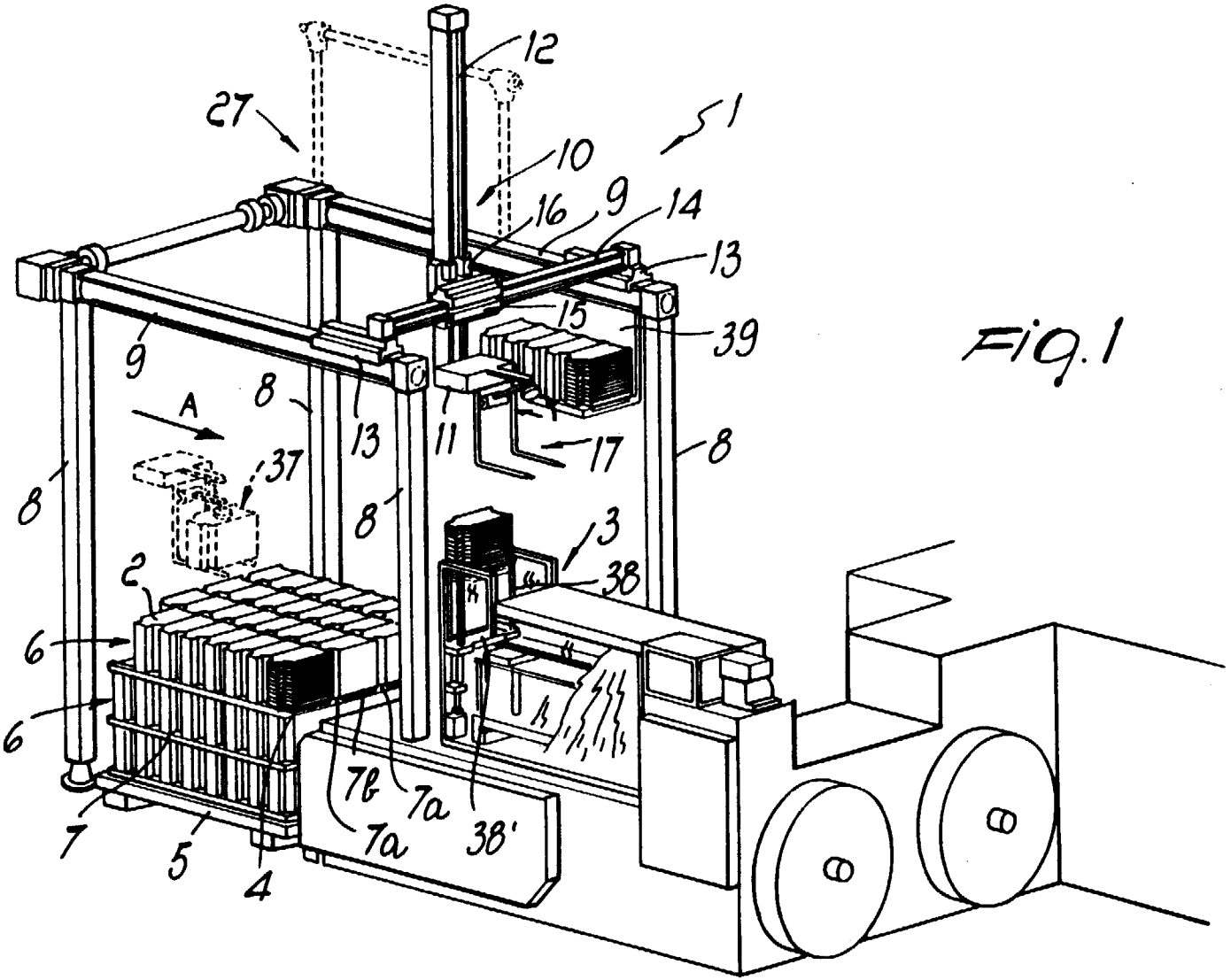
FIG. 1 is a perspective view of the apparatus for feeding packaging machines.

With particular reference to the above-cited drawing figures, the reference numeral 1 generally indicates the apparatus which allows to automatically feed with stacks of cardboard cutouts 2 a hopper 3 which constitutes a station for feeding said cutouts to a conventional packaging machine.

The cardboard cutouts 2 have a substantially rectangular shape which has, at its ends, respectively a tab 2*a* and a trapezoidal indent 2*b*; the cutouts 2 furthermore have appropriate folding and cutting lines suitable for allowing the subsequent packaging operations.

The cutouts 2 are supplied in stacks 4 which are arranged in an orderly manner on pallet-like supporting means 5.

In particular, said stacks are arranged mutually side by side along their longer sides, so as to form parallel rows; said rows are in turn adjacent along the shorter sides of the stacks.

Said stacks 4 are furthermore arranged so as to form superimposed layers 6 which are separated from one another by means of appropriately shaped supporting trays 7. In particular, the supporting trays 7 have, on their upper surface, raised portions constituted by a plurality of parallel ridges 7*a* which are suitable for supporting the opposite longitudinal ends of the cardboard cutouts 2.

The stacks 4 are therefore slightly raised with respect to the upper surface of the supporting trays 7, and 7*b* indicates the through opening or space defined laterally by two adjacent ridges 7*a*, upward by the lower face of each stack 4 and downward by the supporting tray 7.

It should be noted that the upper surface of the pallet 5 has a similar configuration with ridges 7*a*.

The apparatus 1 has a fixed frame which is defined by two pairs of uprights 8 arranged symmetrically along the vertices of a quadrilateral; the uprights 8 have, at their top, a pair of beams 9 which are arranged horizontally parallel. A unit for removing and transferring the stacks 4 of cardboard cutouts, generally indicated by the reference numeral 10, is horizontally movable on the beams 9.

The removal and transfer unit 10 has a head 11 mounted at the lower end of a vertical beam 12. The beams 9 slidably support respective sliders 13 which are connected to one another by a cross-member 14 and can be actuated by means of appropriate actuator elements (not illustrated).

The cross-member 14 slidably supports a sleeve 15 which can be actuated by an appropriate actuation element (not illustrated); a further sleeve 16 is rigidly associated with the sleeve 15 and is perpendicular thereto; the vertical beam 12, which can be actuated by a related actuator element (not illustrated), is slidably mounted therein.

Figure 3:
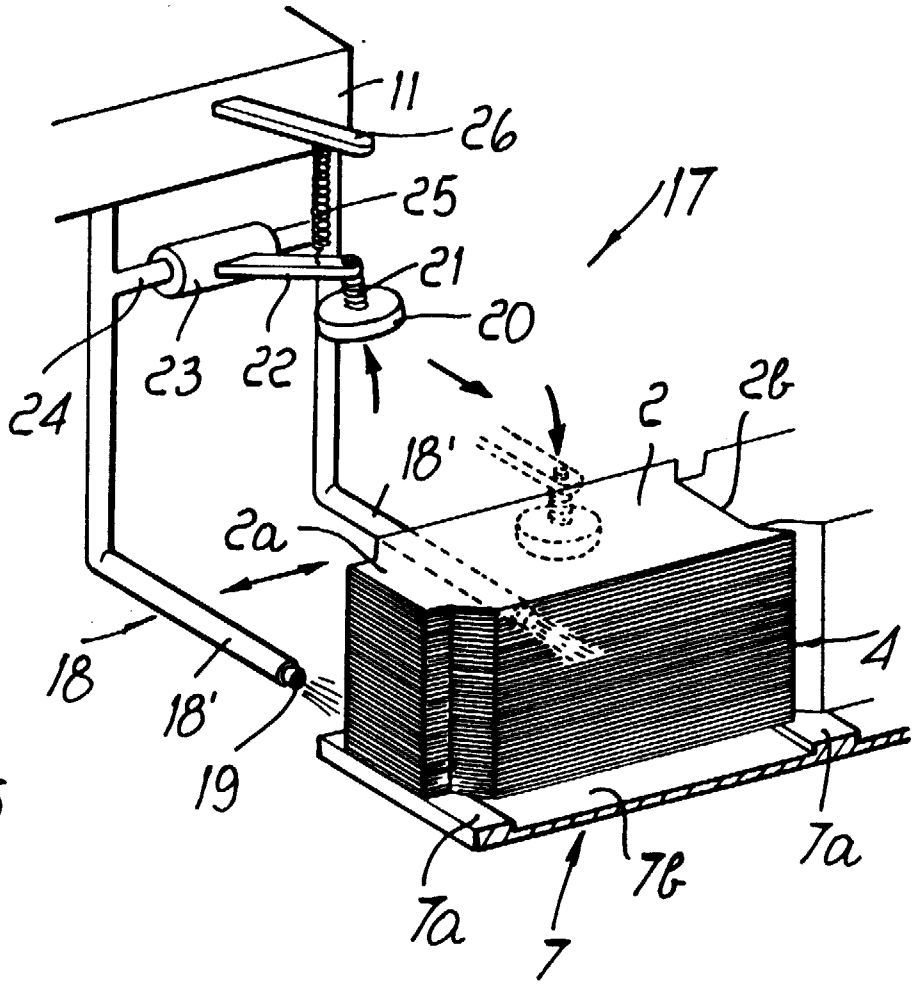
FIG. 3 is a detailed perspective view of the grip element of the removal and transfer unit.

The removal head 11 has a grip element 17 which is substantially clamp-shaped and is illustrated in detail in FIG. 3.

The grip element 17 defines a fork-like configuration 18 provided with two prongs or tines 18' which extend downward with respect to the head 11.

The tines 18', which are bent at right angles, are dimensioned and mutually spaced such that their respective substantially horizontal free ends are insertable within the space 7*b* beneath the stack 4 to be removed.

The ends of the tines 18' preferably furthermore have respective optical empty-space sensors 19 which are intended to provide a signal enabling the insertion of the grip element 17 under the stack 4, as will become apparent hereinafter.

A presser element 20 is adapted for cooperating with the fork 18 and is mounted in an oscillating manner in an upward and substantially median position with respect to the tines 18'.

The presser 20 is supported, by virtue of elastic means constituted by a helical spring 21, by the end of an arm 22 which extends radially from a sleeve 23.

Said sleeve 23 is mounted so as to be rotatable, upon the actuation of an appropriate actuation element (not illustrated) on a stem 24 which is arranged transversely with respect to the fork 18. As can be seen in FIG. 3, the presser 20, upon rotation to a lowered position, is arranged substantially at the middle point of the top surface of the stack 2, which in effect lies on an axis passing through the middle point of the parallelepiped defined by the horizontal tines 18', to thereby achieve an even gripping pressure on the stack 2.

The arm 22 is elastically returned by a helical spring 25 which is fixed to an upper coupling 26 and is suitable for acting against the securing action of the presser 20.

Figure 2:
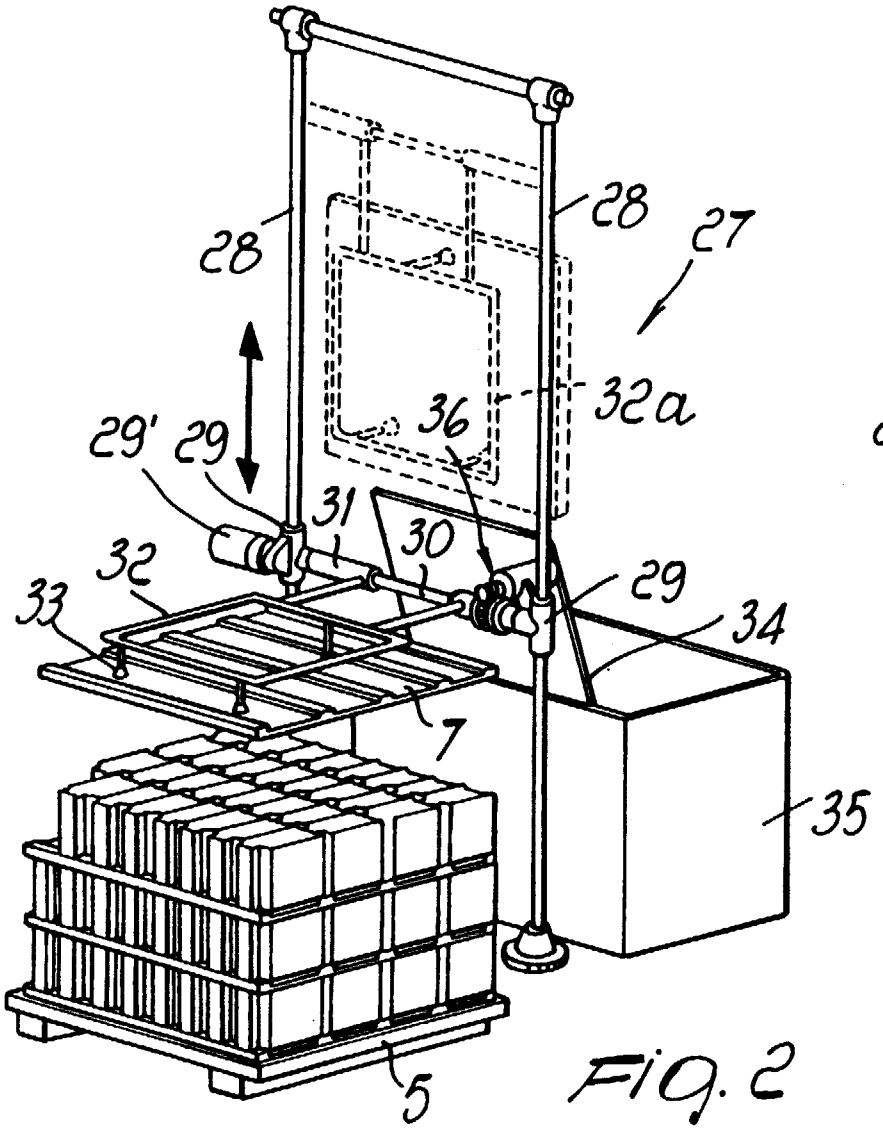
FIG. 2 is a perspective view of the means for removing the emptied supporting trays.

Means 27 for removing the emptied supporting trays 7, more clearly visible in FIG. 2, are arranged on one side of the fixed frame of the apparatus. Said removal means 27 have a vertical frame which is defined by a pair of columns 28 on which respective sleeves 29, connected by a transverse shaft 30, are slidable.

A further pair of sleeves 31 is rotatably mounted on the shaft 30; said sleeves support an oscillating frame 32 which has, on one of its faces, suction means constituted by a plurality of sucker elements 33 connectable to appropriate suction means not illustrated in the figure.

The frame 32 thus has a combined movement, i.e., a sliding movement along the columns 28 and a rotation movement about the shaft 30.

The frame 32 is consequently capable of moving between a first lower position, in which it is arranged horizontally above the supporting tray 7 to be removed, and a second upper position, shown in broken lines 32*a*, in which it assumes a position which is substantially vertical and parallel to the plane of the columns 28.

In said second position, the removed supporting tray 7 is released by said sucker elements 33, so as to fall, by means of a slide 34, into a removal container 35.

The sucker elements 33, in said first position of the frame 32, are obviously directed downward so as to adhere to the tray 7.

The vertical sliding of the frame 32 along the columns 28 occurs upon the actuation of reversible actuation means 29', whereas the oscillation about the axis 30 is imparted thereto by reversible actuation means 36.

The operation of the described device is as follows.

The pallet 5, which supports in an orderly arrangement the stacks 4 of cutouts to be transferred to the packaging machine, is inserted at the base of the apparatus, between the two pairs of uprights 8.

In said position the pallet 5 is arranged below the removal and transfer unit 10 which is movable along the beams 9.

In particular, the removal head 11 is movable along three orthogonal axes and can therefore be arranged exactly at the first stack 4 to be transferred and subsequently lowered in front of said stack.

The movements of the head 11 are conveniently controlled by an appropriate electronic control unit (not illustrated) of a known and commercially available type normally used in three-axis measurement machines.

The fork 18 is caused to advance so as to cause the tines 18' to become inserted under the stack 4 in the region 7*b* comprised between the ridges 7*a* of the supporting tray 7.

The optical sensors 19 allow to check that said space or opening 7*b* is indeed present in front of the respective tines 18', giving the enabling signal for the insertion of the fork 18.

For the same purpose it is possible, as an alternative, to provide the use of conventional optical-fiber sensor means which can be connected to a TV camera for a readout for comparison with appropriate reference values.

After the entry of the grip element into the space 7*b* has moved the tines 18' to adhere to the stack 4 in a downward position, the presser element 20, upon actuation of the respective actuation element, lowers into contact with the upper surface of said stack.

The stack 4, secured between the fork 18 and the presser element 20, is then raised above the related layer 6, as indicated in broken lines by 37, and then moved in the transfer direction A which is parallel to the beams 9 until it is above the feed hopper 3.

The stack 4 is subsequently inserted in the hopper 3 and released by the grip element 17 after the lifting of the presser element 20.

It should be noted that during the transfer step the stack 4 is arranged with the longer sides of the cutouts 2 horizontally perpendicular to the direction A.

The hopper 3 is conveniently constituted by a plurality of angular profiled elements 38 which are arranged vertically according to the vertices of a rectangle and are suitable for guiding the stack 4; the profiled elements 38 extend from a frame 38', which supports the stack 4 and is arranged above a per se known stripper element suitable for separating the individual cutouts 2 of the stack to be transferred to the processing line of the packaging machine.

Removal from the pallet 5 and transfer to the feed hopper 3 of the other stacks 4 of cutouts which form the layer 6 are subsequently performed in a similar manner.

Once the transfer of the entire layer 6 of stacks is completed, the descent of the oscillating frame 32 is actuated from the upper vertical position to the lower horizontal position to remove the supporting tray 7.

In said first horizontal position of the frame 32, the suckers 33 grip the supporting tray 7, which is then lifted and rotated and finally, once said second position has been reached, the tray 7 is allowed to fall into the container 35.

It should be noted that the intervention of the actuation means 29' and 36 is adjusted so as to avoid any sliding of the supporting tray 7 on the stacks 4.

In particular, in the final steps of the approach of the frame 32 to the supporting tray 7, as well as in the initial steps of removal of the supporting tray 7 from the underlying layer of stacks 4, the frame 32 is arranged in a perfectly horizontal position and is moved exclusively by the actuation means 29'.

To conclude, the described apparatus allows to feed packaging machines with stacks of cardboard cutouts in a fully automatic manner. In particular, the apparatus transfers one stack at a time, providing a high operating speed which is adequate for the operating speed of conventional packaging machines.

It should be noted that the apparatus according to the present invention allows to directly feed the feed hopper 3 of the packaging machine, with evident advantages, in terms of constructive and operative simplicity, with respect to known devices, wherein said feeding occurs by interposing conveyor belts.

Conveniently, it is possible to store an appropriate amount of stacks on a fixed ledge 39 from which it is possible to draw during the step of changing the emptied pallets 5 so as to not interrupt the operation of the machine. The ledge 39 extends below a beam 9 longitudinally to the transfer direction A.

Said ledge 39 in turn has longitudinal ridges for supporting the ends of the stacks, so as to allow the insertion of the fork 18 of the grip element 17 below said stacks.

In the practical embodiment of the invention, the materials employed, as well as the shape and dimensions, may be any according to the requirements.

Furthermore, any suitable actuation elements may be employed, such as, e.g., electric motors and kinematic transmission members, etc.

I claim:

1. Apparatus for feeding packaging machines with stacks of substantially flexible sheet material which are arranged mutually side by side on a supporting means in a manner so as to form superimposed layers separated by supporting trays which have, on their upper face, raised portions which define a space between said supporting trays and each of said stacks, said apparatus comprising a unit for the removal and transfer of said stacks of sheet material from said trays which includes a first frame which is provided with a pair of horizontal parallel beams mounted on uprights and a horizontal cross member slidably mounted between said horizontal beams, said first frame defining an area for accommodating said stacks of sheet material above which said cross member is horizontally movable, said unit further comprising a first sleeve slidably mounted on said cross member and a second sleeve connected to said first sleeve in which is slidably mounted a substantially vertical beam. said unit further comprising a head which is connected to said vertical beam at a lower end thereof, said head comprising a grip element for a stack which is constituted by at least one pair of horizontal tines mutually arranged parallel and distanced apart, and a presser element rotatably mounted above said pair of horizontal tines, said tines being positionable in said space defined between said supporting trays and said stacks, and said tines defining free ends which are provided with optical empty space sensors for sensing said space and for providing an enabling signal, upon said sensing, for the insertion of said tines into said space, said presser element being rotatably positionable between a raised upper non-engaging position and a lowered position in which said presser element is adapted to supply a substantially uniform gripping pressure to a stack between said pair of tines and said presser element, said apparatus further comprising means for removing emptied supporting trays which include an oscillating frame rotatably and vertically slidably mounted on an upright column support arranged laterally to said first frame, said oscillating frame being provided with a suction means for gripping said emptied supporting trays.

2. Apparatus according to claim 1, wherein said presser element is constituted by a cylindrical spring-loaded presser which is arranged, in said lowered position, at a vertical axis which substantially intersects a center point of a parallelepiped defined by said pair of horizontal tines.

3. Apparatus according to claim 1, further comprising a fixed ledge connected to said first frame for storing a reserve of said stacks to be drawn from during a step of changing said emptied supporting trays.

4. Apparatus according to claim 1, further comprising an input hopper arranged at said packaging machine, said input hopper being formed by a plurality of vertically arranged angular profiled elements adapted to guide said stacks on a frame of said packaging machine.

* * * * *